United States Patent [19]

Zimmer et al.

[11] Patent Number: 4,550,681

[45] Date of Patent: Nov. 5, 1985

[54] APPLICATOR FOR UNIFORMLY DISTRIBUTING A FLOWABLE MATERIAL OVER A RECEIVING SURFACE

[75] Inventors: Johannes Zimmer, Ebentaler Str. 133, A-9020; Karl Mayer, Klagenfurt, both of Austria

[73] Assignee: Johannes Zimmer

[21] Appl. No.: 539,913

[22] Filed: Oct. 7, 1983

[30] Foreign Application Priority Data

Oct. 7, 1982 [AT] Austria ..... 3716/82
Oct. 7, 1982 [AT] Austria ..... 3717/82

[51] Int. Cl.[4] ..... B05C 5/02

[52] U.S. Cl. ..... 118/410; 101/120; 118/406; 118/409

[58] Field of Search ..... 118/410, 406, 411, 409; 101/120; 418/205, 206

[56] References Cited

U.S. PATENT DOCUMENTS

| | | | |
|---|---|---|---|
| 2,474,254 | 6/1949 | Kauffman | 118/410 |
| 2,734,224 | 2/1956 | Winstead | 118/410 X |
| 2,982,995 | 5/1961 | Groleau | 118/410 X |
| 3,020,579 | 2/1962 | O'Connor | 118/410 X |
| 3,381,336 | 5/1968 | Wells | 118/410 X |
| 3,610,201 | 10/1971 | Meyer | 118/410 X |
| 3,992,990 | 11/1976 | Zimmer | 118/406 X |
| 4,023,487 | 5/1977 | Mitter | 101/120 |
| 4,387,124 | 6/1983 | Pipkin | 118/413 X |

*Primary Examiner*—John P. McIntosh
*Attorney, Agent, or Firm*—Karl F. Ross; Herbert Dubno

[57] ABSTRACT

A flowable material, such as an impregnant, a dyestuff or a bonding agent, is applied to the surface of a relatively moving substrate by way of a channel system formed in a plate surface, in a stack of slabs or in a solid block. This channel system has a branched structure extending from an entrance port to a multiplicity of exit ports, the branch channels becoming progressively more numerous and correspondingly narrower toward these exit ports. The latter, extending in a row transverse to the direction of motion across the full width of the substrate surface, open onto that surface directly or through one or more discharge nozzles in the form of a slot or a multiplicity of orifices, possibly with interposition of a gear pump whose toothed cylinders are floatingly received in part-cylindrical cutouts of the body slightly exceeding their diameter.

12 Claims, 16 Drawing Figures

APPLICATOR FOR UNIFORMLY DISTRIBUTING A FLOWABLE MATERIAL OVER A RECEIVING SURFACE

FIELD OF THE INVENTION

Our present invention relates to an applicator for uniformly distributing a flowable material, e.g. an impregnant, a dyestuff or a bonding agent, over a surface of a substrate moving relatively to the applicator, such as a web of fabric or paper to be inprinted through a silk screen, for example.

BACKGROUND OF THE INVENTION

Recent developments in screen-printing machinery enable the treatment of web surfaces having widths of five meters or more. As the width of the surface to be coated or impregnated increases, the maintenance of a uniform flow along a discharge slot of an applicator nozzle becomes ever more difficult. The requisite equalization of the supply pressure over the full width of the substrate creates problems especially with fast-running machines designed to apply only a thin layer of the flowable material to the underlying surface, as will generally be the case in the printing of a nonabsorbent substrate. In principle, the term "flowable material" encompasses foaming and nonfoaming liquids of various viscosities, gases and also comminuted matter; for convenience, however, we shall hereinafter refer to that material as working fluid.

The use of positive-displacement pumps for the forced feeding of the working fluid to a discharge slot has already been proposed in conjunction with screen-printing machines in which a wiper in the form of a doctor blade or a roller adjoins that slot to control the layer thickness. Such pumps, however, generally operate with significant pressure variations resulting in objectionable marks on the substrate surface. The utilization of gravity feed from an elevated supply vessel obviates this inconvenience but has the drawback that the channel system of the applicator, conducting the working fluid from its inlet to its outlet, tends to retain substantial portions of that fluid at the end of a printing operation. This requires a thorough cleaning of the channels before the next operation and entails losses of dyestuff which can be relatively significant in the case of short production runs.

OBJECTS OF INVENTION

The general object of our present invention is to provide an improved applicator of the character referred to, designed to obviate the drawbacks of conventional devices of this kind.

A more particular object is to provide means for controlling the flow rate and/or the effective operating width of such an applicator.

SUMMARY OF THE INVENTION

We have found, in accordance with an important feature of our present invention, that uniform distribution of a working fluid over a relatively moving substrate surface—even when the width of that surface is several meters as noted above—is achievable by means of an applicator body which is provided with a channel system having a branched structure that extends from an entrance port to a multiplicity of exit ports disposed in a row transverse to the direction of relative substrate motion, the branches of the channel system becoming progressively more numerous and correspondingly narrower from the entrance port to the exit ports.

Advantageously, this channel system forms a multiplicity of tiers or levels which parallel the row of exit ports and communicate with one another through bores or other connecting passages, the number of these branches increasing—e.g. by a factor of 2—from one tier to the next.

The production of such a channel system, which needs to be closed on all sides except for its entrance and exit ports, creates some problems which in accordance with further features of our invention are solved by forming that system on an initially accessible area of the applicator body which is subsequently covered up. Thus, the body may comprise two juxtaposed plates with confronting faces at least one of which is provided with a network of grooves constituting the channel branches; preferably both confronting faces are grooved in this manner to increase the fluid-carrying capacity of the channels. Another possibility is to divide the body into a stack of slabs which are perpendicular to the direction of relative motion and have longitudinally extending cavities forming respective tiers of the channel system, with apertures in the cavity bottoms establishing the connections between adjoining tiers. We may also design the applicator body as a block, e.g. cylindrical or prismatic, in which the channels are formed as peripheral incisions that are subsequently covered up by a shell or housing embracing that block. The shell may be unitary or split into separable sections.

We have further found that objectionable clogging of the narrower passages of such a channel system can be avoided by connecting same in cascade with a gear pump disposed inside the applicator body, preferably in an intervening space between the exit ports of the channel system and an elongate outlet paralleling the row of these ports.

Pursuant to a more particular feature of our invention, which is also usable in an applicator wherein a flow path for the working fluid is defined by a more conventional channel system, the gear pump comprises two cylinders with intermeshing peripheral teeth that are floatingly received with slight peripheral clearance in respective part-cylindrical cutouts flanking that flow path, the diameters of these cutouts thus barely exceeding those of the orbits of the gear teeth. Such a gear pump, when driven at a constant speed, will generate a virtually uniform fluid pressure in a downstream part of the flow path, especially when the rollers or cylinders are counterrotated in directions entraining the working fluid between their own peripheries and the walls of their cutouts rather than through the nip of these cylinders. Such a gear pump, accordingly, obviates the pressure fluctuations which tend to form unsightly streaks in surfaces printed with dyestuff applicators using conventional positive-displacement pumps.

Another advantageous feature of our invention resides in the provision of externally controllable means for partly or completely blocking the flow of the working fluid through the applicator. With a multitier channel structure as discussed above, such blocking means may comprise at least one shutter movable along a tier for selectively obstructing part of its channel branches, thereby limiting the effective width of the discharge slot constituting the applicator outlet. Another type of flow-blocking member usable with our improved applicator comprises a rod movable in an enlarged lodgment of the flow path that is separated from the intermediate space which contains the aforedescribed gear pump, this rod extending parallel to the axes of the pump cylinders and thus to the discharge slot. Such a rod could also be used for a partial blockage or throttling of the overall flow by being externally threaded or otherwise peripherally grooved, thereby enabling some of the fluid to traverse the lodgment obstructed by it. With or without such a grooved periphery, the rod is advantageously designed as an open-ended tube with one or more apertures facing in the upstream direction of the flow path for carrying off excessive working fluid.

In all instances we may replace the throughgoing discharge slot by a planar array of closely juxtaposed nozzle orifices designed to distribute dyestuff or other working fluid on the substrate along discrete zones rather than in a continuous layer.

With a discharge slot bounded by two halves of a split housing, such an array can be formed by parallel ribs on one or both slot walls; in the case of a unitary housing we may provide its discharge slot with a corrugated or otherwise ribbed insert to form these orifices.

BRIEF DESCRIPTION OF THE DRAWING

The above and other features of our invention will now be described in detail with reference to the accompanying drawing in which.

SPECIFIC DESCRIPTION

Figure 1:
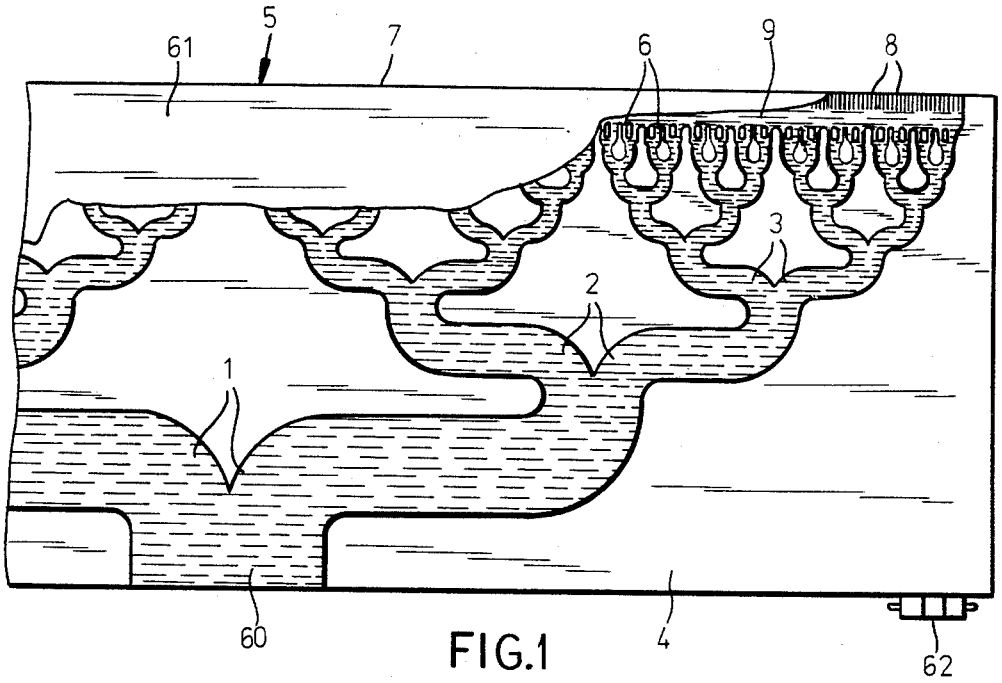
FIG. 1 is a face view, with parts broken away, of an applicator body provided with a branched channel system according to our invention.

Reference will first be made to FIG. 1 in which we have shown a representative portion of a pair of juxtaposed plates 5 and 61 (the latter being partly broken away) which are hingedly interconnected at 62. The confronting faces of these plates, of which only the face 4 of plate 5 is visible, are provided with coextensive grooves forming a channel system extending between an entrance port 60 and a multiplicity of exit ports 6. This channel system has a branched structure with levels or tiers 1, 2, 3 etc. in which the branches double in number from one tier to the next while becoming progressively smaller in cross-section. The last tier, constituting the exit ports 6, is separated by a transverse channel 9 from a multiplicity of outlet orifices 8 arrayed along upper plate edges 7 opposite the hinges 62. After the grooves have been formed, the two plates are firmly interconnected by releasable fasteners such as screws or clips enabling their separation for cleaning purposes. When cleaning is not necessary, the hinges 62 can be omitted and the plates can be permanently interconnected, as by cementing or by riveting. The illustrated arrangement is designed to apply a working fluid to the underside of a cylindrical substrate which could be a web or a transfer roller e.g. as shown in a copending application Ser. No. 480,113, filed Mar. 29, 1983 by one of us, Johannes Zimmer.

Figure 15:
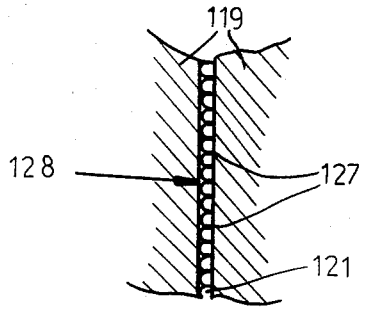
FIG. 15 is a sectional detail view taken on the line XV—XV of FIG. 14.

When dyestuff or some other working fluid under pressure is fed to the entrance port 60, e.g. under gravity from an overlying vessel not shown, the fluid will be uniformly distributed among the exit ports 6 and the outlet orifices 8. The array of orifices could be replaced by a throughgoing discharge slot which may be fitted with a ribbed insert, e.g. as shown in FIG. 15 discussed hereinafter.

Figure 2:
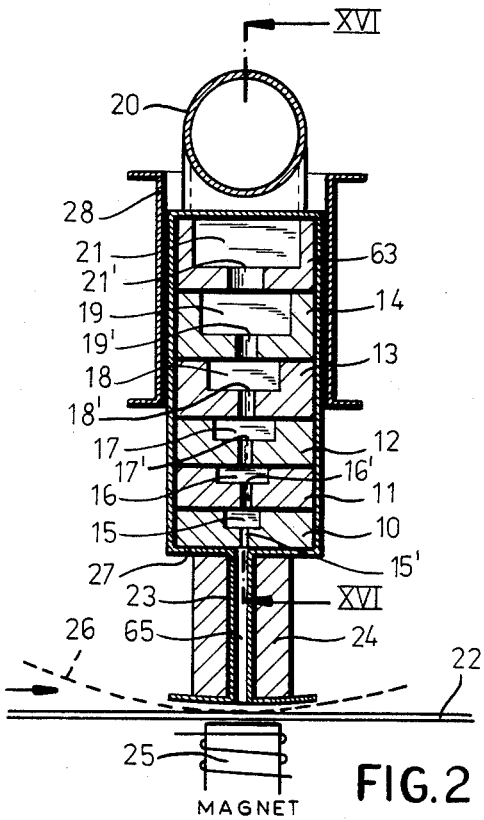
FIG. 2 is a sectional elevational view of a modified applicator body comprising a stack of slabs.
Figure 16:
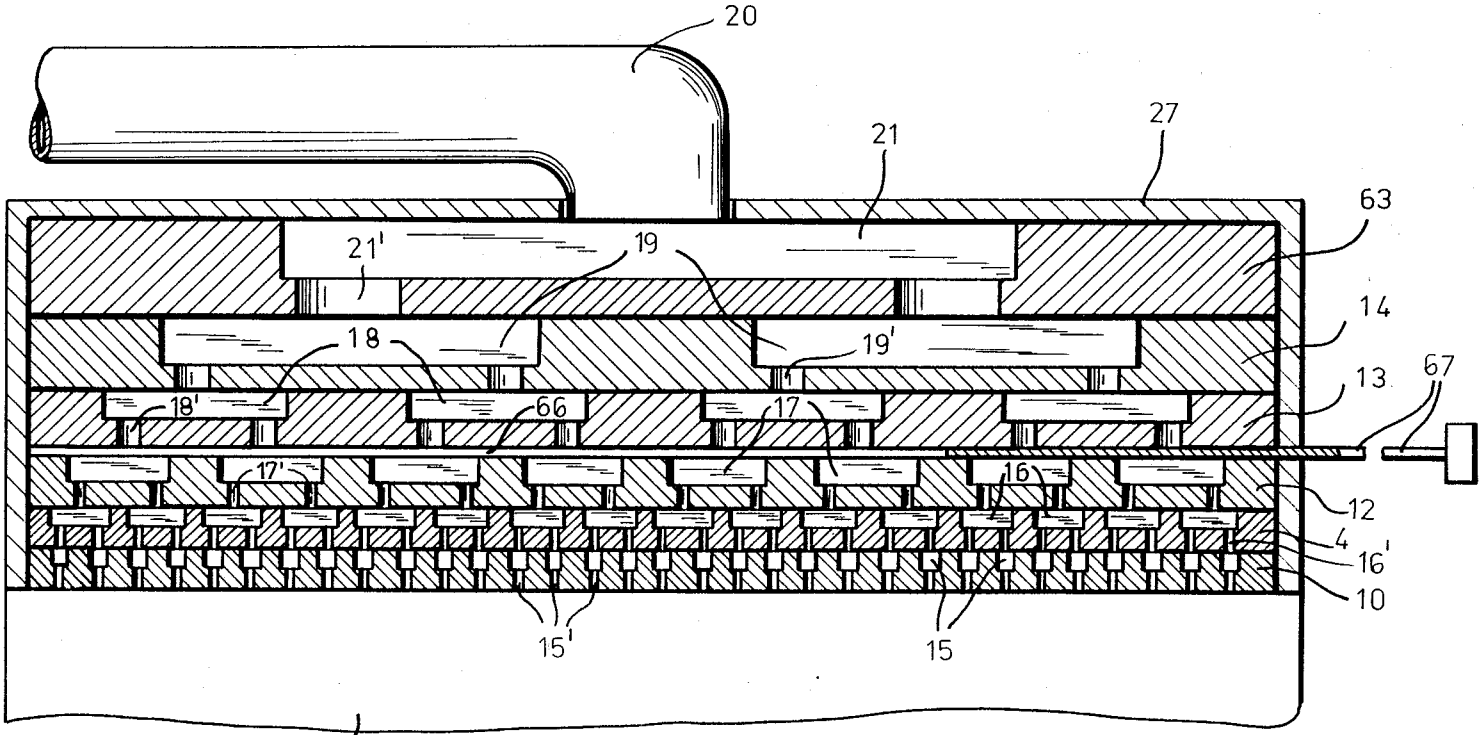
FIG. 16 is a cross-sectional view taken on the line XVI—XVI of FIG. 2.

FIGS. 2 and 16 illustrate a modified applicator according to our invention provided with a multilevel channel system generally similar to that of FIG. 1. This applicator comprises, essentially, a stack of elongate slabs 10–14 and 63, the latter having a cavity 21 serving as an entrance port and receiving working fluid from a supply pipe 20. The underlying slabs 14, 13 etc. have progressively more numerous but narrower cavities 19, 18, 17, 16 and 15, each of them being designed as an upwardly open recess communicating with a cavity in the next-higher slab through a respective restricted bottom bore 21', 19', 18', 17' and 16'. The cavities 15 of the lowest slab 10, of which there are 32 as seen in FIG. 16, are provided with respective exit ports 15' opening onto a discharge slot 65 in a downward extension 23 of a housing 27 surrounding the stack of slabs 10–14 and 63. Slot 65, which could also be provided with a ribbed insert as shown in FIG. 15, opens onto a substrate 22 in the form of a web to be imprinted through a cylindrical silk screen 26 as is well known per se. Housing 27 is vertically slidable in a frame 28 and may be attracted onto the inner peripheral surface of screen 26 by an electromagnet 25 underneath web 22 which coacts with a ferromagnetic armature 24 mounted in housing extension 23.

FIG. 16 also shows rabbets 66 flanking the cavities 17 of slab 12 to serve as guides for a shutter 67 in the form of a flat blade which is insertable through a wall slot of housing 27 so as to overlie the cavities 17 of that slab to a desired extent, thereby cutting off the flow of working fluid to some of the underlying exit ports 15' in order to adapt the effective length of the discharge slot 65 to the width of the web 22 being treated. If desired, two such shutters could be simultaneously inserted from opposite sides into the guide track formed by rabbets 66. Other tiers of the stack could be equipped with similar shutters for a coarser or finer adjustment of the effective slot length.

Figure 3:
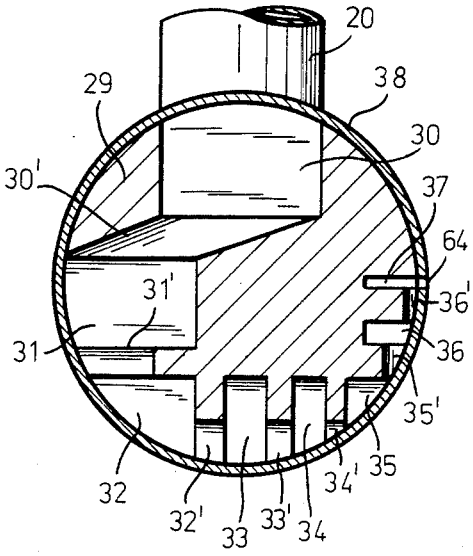
FIG. 3 is a cross-sectional view of a cylindrical applicator according to our invention.

FIG. 3 shows the essential constituents of another applicator according to our invention comprising a cylindrical body 29 enclosed within a shell 38. Body 29 has a peripheral entrance port 30 to which working fluid is supplied, as in the preceding embodiment, by a pipe 20. Port 30 communicates by way of bores 30' with two second-tier cavities 31, only one of which is visible in the cross-sectional view of FIG. 3 and which in turn is connected by passages 31' with four cavities 32 of the next-following tier. Passages 32', 33', 34', 35' and 36' similarly connect cavities 32 and further cavities 33–36 of subsequent tiers, whose number increases according to a geometrical progression as illustrated in FIG. 16 for the stacked applicator described above, with one another and with a multiplicity of outlet ports 37 opening onto a discharge slot 64 of shell 38. This slot, which again could be fitted with a ribbed insert as discussed above, opens onto one side of the applicator for delivering working fluid to a curved web or a transfer roller as illustrated in the aforementioned copending application Ser. No. 480,113.

With the exception of bores 30', which in the absence of shell 38 can be readily machined by way of cavities 31, all cavities (including entrance port 30) and intervening passages of applicator body 29 extend along its periphery so as to be conveniently producible. The cavities, of course, are closed at their ends; here, too, a slidable shutter as shown at 67 in FIG. 16 can be provided for selective obstruction of some of the cavities or their connecting passages.

Figure 4:
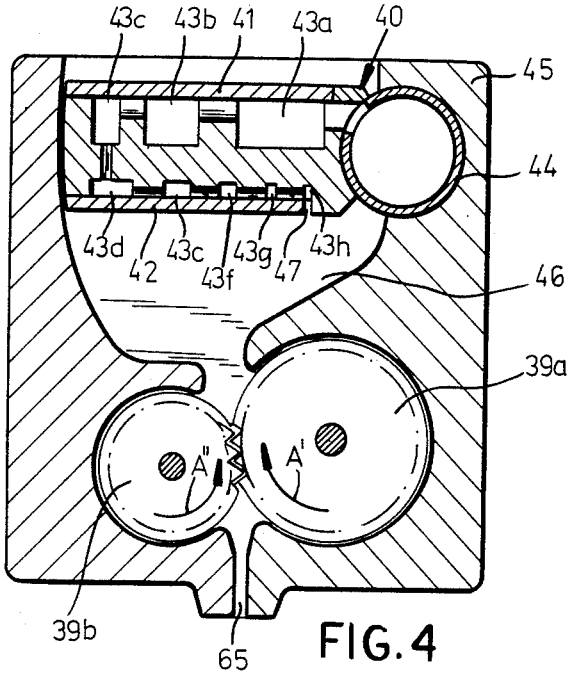
FIG. 4 is a cross-sectional view of the body of another such applicator provided with a gear pump.

FIG. 4 shows an applicator body in the form of a prismatic block 45 whose upper part is provided with a downwardly converging space 46 bounded at the left by a cylindrical wall 46' centered on the axis of a horizontal supply pipe 44 which is rotatably lodged in a part-cylindrical upper cutout of that block. Pipe 44 is rigid with a plate-shaped insert 40 which is provided with a branched channel system similar to that of the preceding embodiments, including cavities **43*a*–43*h* formed in the major surfaces of this insert and interconnected by passages similar to those described with reference to FIG. 3. The first-tier cavity 43*a*, again serving as an entrance port, receives working fluid under pressure from pipe 44; the fluid is then uniformly distributed among the last-stage cavities 43*h* which act as exit ports emitting it into the space 46. The cavities of insert 40 are covered by upper and lower face plates 41 and 42, plate 42 having an edge 47 spaced from a confronting shoulder of insert 40** to provide a gap for the discharge of the fluid.

The end of insert 40 remote from pipe 44 is cylindrically curved to conform to the curvature of wall 46' whereby that insert can pivot under its own weight, together with pipe 44, about the axis of that pipe so as to exert additional pressure upon the pool of working fluid accumulating in space 46. A flow path extending from space 46 to an outlet slot 65 is flanked by a pair of part-cylindrical cutouts of block 45 accommodating two counterrotating cylindrical rollers **39*a*, 39*b* of a gear pump, these rollers being provided with intermeshing peripheral teeth and being floatingly received with small clearance in their cutouts as more fully described hereinafter with reference to FIGS. 11 and 12. The rollers 39*a*, 39*b* are set in rotation by nonillustrated drive means, symbolized by arrows A' and A'', connected with at least one of these rollers by a conventional coupling allowing for limited relative radial displacement. The sense of rotation is such that working fluid descending from space 46 is positively entrained by the gear teeth of the pump between the peripheries of rollers 39*a*, 39*b*** and the concave walls of their respective cutouts.

Figure 5:
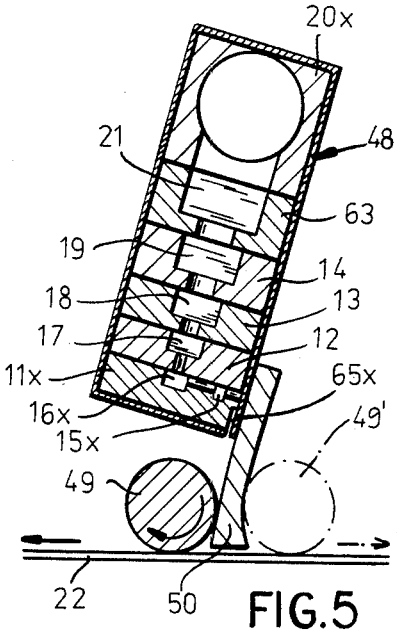
FIGS. 5 and 6 are views similar to that of FIG. 2, illustrating the stack-type applicator along with two types of wipers.

FIG. 5 shows a stacked applicator 48, similar to that of FIGS. 2 and 16, mounted somewhat inclinedly by a support 50 above the surface of a flat substrate 22 to be coated or impregnated. The uppermost slab 63 of this applicator is overlain by a block **20*x* forming a supply conduit for feeding the working fluid to the uppermost cavity 21. The lowermost slab of the stack, designated 11*x*, forms two sets of cavities 16*x* and 15*x*; the latter constitute exit ports communicating with a discharge slot 65*x* at the bottom of the surrounding housing. Exiting fluid passes between support 50 and a roller 49 operating as a spreader and wiper when the substrate moves to the left as indicated by a solid arrow. With the substrate moving in the opposite direction, as marked by a dot-dash arrow, roller 49 may be replaced by another roller 49' at the side of support 50 remote from the discharge slot 65*x***.

Figure 6:
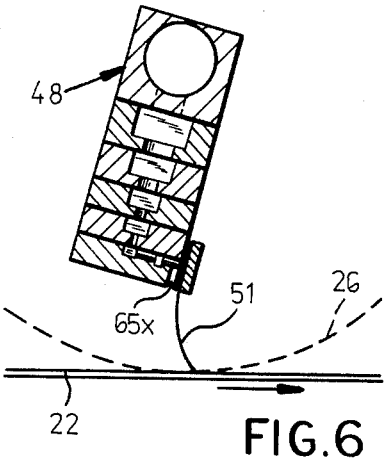

In FIG. 6 we have shown the applicator 48 of FIG. 5 (held in position by nonillustrated support means) separated from substrate 22 by a cylindrical printing mask such as a silk screen 26 whose inner surface is being wiped by a flexible blade 51 descending from discharge slot **65*x***.

Figure 7:
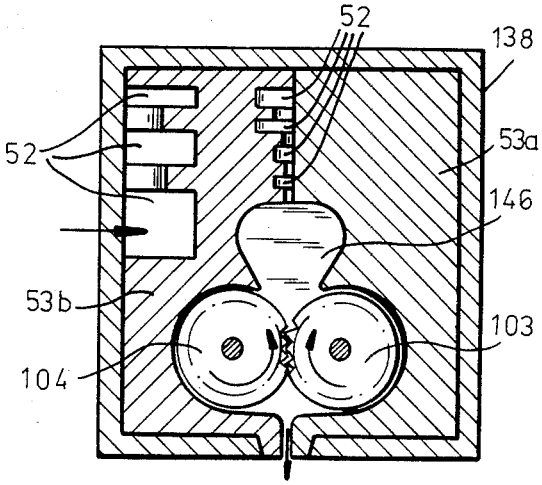
FIG. 7 is a cross-sectional view similar to that of FIG. 3 but illustrating a prismatic applicator also equipped with a gear pump.

In FIG. 7 we have shown an applicator whose body is a prismatic block, similar to that of FIG. 4, split into two halves **53*a* and 53*b* that are held together by a surrounding shell 138 of rectangular cross-section. The two halves 53*a* and 53*b* are formed near their bottom with part-cylindrical cutouts accommodating two intermeshing rollers 103 and 104 of a gear pump differing from that of FIG. 4 only in that the roller diameters are identical. An overlying intermediate space 146 receives working fluid through a cascade of cavities 52 which are formed in the major surfaces of block 53*b*** and, as before, are part of a multitier channel structure.

It is worth noting that the cavities of the channel systems of FIGS. 2–7 and their interconnecting passages need not be of constant cross-section, as shown, but could also converge in the direction of fluid flow. It is further possible to replace one or more of the entrance-side tiers or cavity levels by correspondingly branched supply conduits connecting a first multicavity level to an entrance port. In some instances the sets of cavities of the several tiers could be inclined to one another instead of being mutually parallel as in the described embodiments. With reversal of the sense of rotation of the gear pumps of FIGS. 4 and 7, or of other feed means in cascade with the channel system, the exit ports may be utilized to pick up excess working fluid and return it through the system to its reservoir.

It will also be apparent that nozzle orifices 8 of a flat applicator, such as that of FIG. 1, could be juxtaposed in staggered relationship with corresponding arrays of one or more adjoining applicators to reduce the pitch of the outlet openings of the resulting assembly. Thus, for example, a channel structure like that of FIG. 1 or FIG. 16 but with eleven tiers will have 1,024 exit ports with a center-to-center spacing of about 2 mm in the case of a substrate 2 meters in width. When that width is increased to 6 meters, the spacing of the exit ports—and thus the pitch of outlet orifices respectively aligned therewith—would be about 6 mm unless further tiers were added. The relative staggering of several rows of such outlet orifices, either in a single applicator or in a plurality of juxtaposed applicators, eliminates the need for such an expansion of the channel structure.

Figure 8:
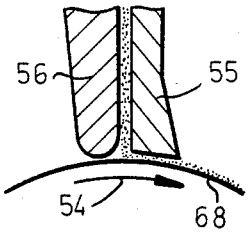
FIGS. 8, 9 and 10 are cross-sectional detail views showing different outlet structures for an applicator according to our invention.
Figure 9:
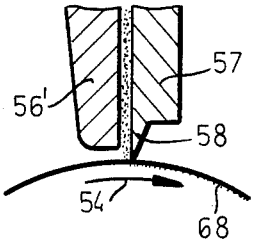
Figure 10:
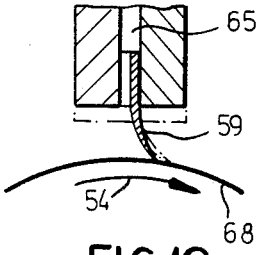

In FIGS. 8, 9 and 10 we have depicted several possible configurations of an applicator outlet usable with the present improvement. In all three instances, the substrate is in the form of a cylinder 68 underlying the applicator outlet and rotating clockwise as indicated by an arrow 54. FIG. 8 shows a discharge slot bounded by two lips 55 and 56, the downstream lip 55 being slightly retracted from the substrate surface with reference to the upstream lip 56 which has a rounded lower edge contacting or closely approaching the workpiece. This structure is particularly suitable for the application of a coating layer of predetermined thickness. FIG. 9 shows the downstream lip 57 provided with a downwardly converging ridge 58 which projects beyond the upstream lip 56' to act as a doctor blade limiting the thickness of the coating. According to FIG. 10 a discharge slot 65, bounded by two coextensive lips, is partly occupied by an elastic tongue 59 which curves toward the substrate in a manner generally similar to that illustrated for the wiper blade 51 of FIG. 6; in phantom lines we have indicated a possible displacement between the substrate 68 and the nozzle forming the slot 65. The upper part of that slot could be occupied by a ribbed or corrugated insert, again as shown in FIG. 15 to be discussed hereinafter.

Figure 11:
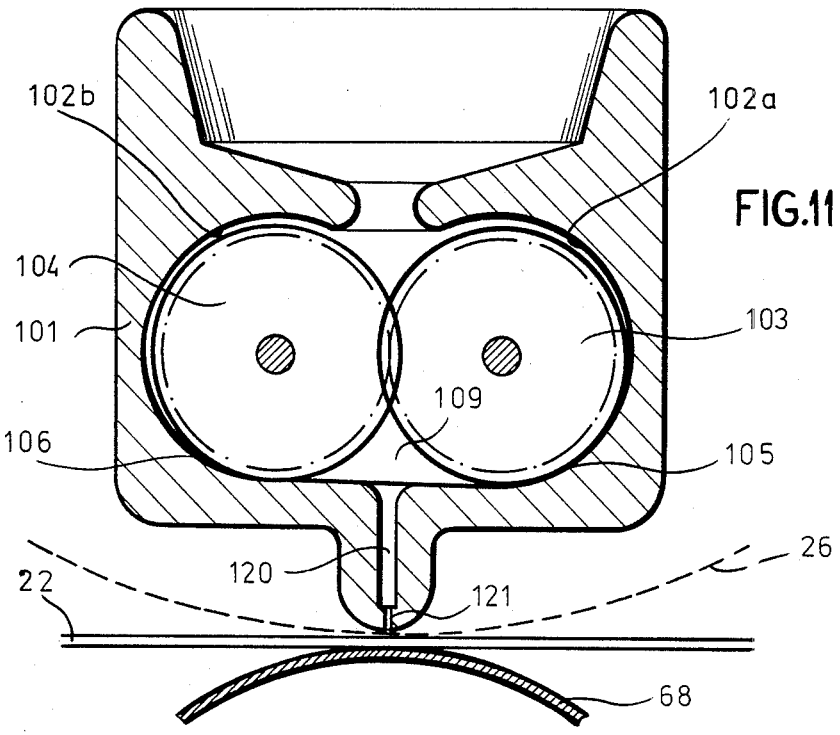
FIG. 11 is a cross-sectional view of an applicator with a body similar to the lower part of FIG. 4, again including a gear pump.
Figure 12:
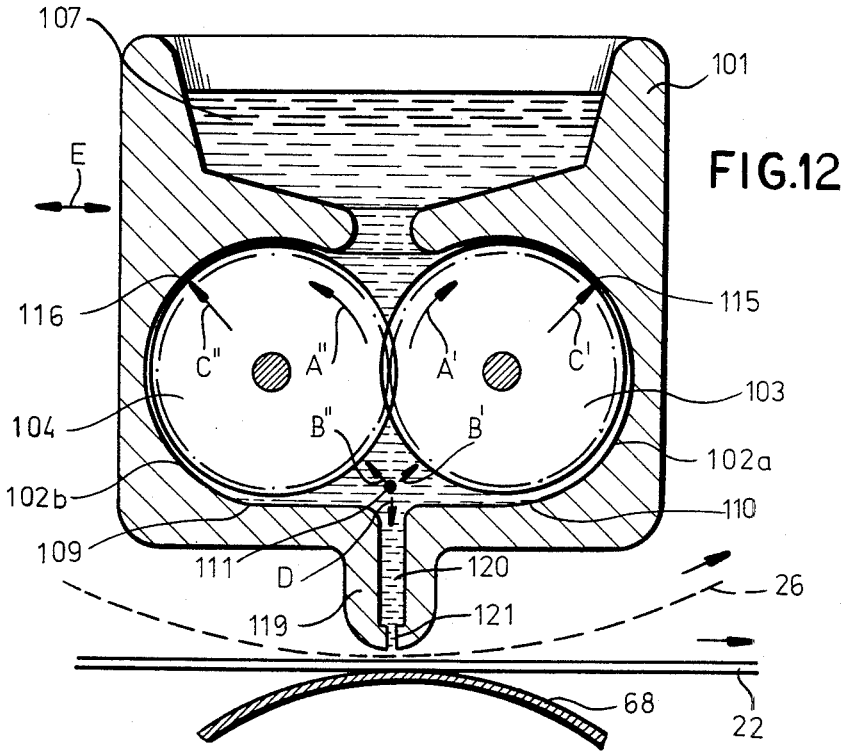
FIG. 12 shows the assembly of FIG. 11 with the gear pump in operation.

FIGS. 11 and 12 show an applicator body 101 which is generally similar to the lower part of body 45 or 53*a*, 53*b* of FIG. 4 or FIG. 7 and, as in these prior embodiments, may be provided with a branched channel system of the type described. Body 101 is formed with two part-cylindrical cutouts 102*a*, 102*b* accommodating respective toothed rollers 103, 104 of a gear pump with slight peripheral clearance resulting from a small difference between the radii of the cylindrical cutout surfaces and of the orbits of the gear teeth. FIG. 11 represents a quiescent position in which the pump is not driven; rollers 103 and 104 then rest under their own weight on the lower peripheries of their cutouts which they contact along lines 105 and 106.

When the overlying storage space is filled with working fluid 107 as illustrated in FIG. 12, and the rollers 103, 104 have been set in rotation by their drive means symbolized by arrows A' and A'', the fluid is entrained into an underlying space 109 formed below the nip of the intermeshing rollers which communicates with a discharge slot 120 terminating in a restricted outlet 121, defined by a nozzle 119, whereby pressure is built up in that space. That pressure, as indicated by arrows B' and B'', tends to lift the rollers off their seats and into contact with the upper cutout peripheries at lines 115 and 116 as indicated by arrows C' and C''. The resulting close contact between the gear teeth of rollers 103, 104 and the concave walls of cutouts 102*a*, 102*b* ensures a uniform positive entrainment of the fluid 107 toward outlet 121 under a downward pressure indicated by an arrow D. The discharged fluid is shown to pass, as in FIG. 6, through a cylindrical silk screen 26 onto a web 22 supported by a rotating cylinder 68. An arrow E indicates the possibility of limitedly shifting the applicator 101 relative to the web 22 and its supporting cylinder 68; a relative vertical adjustment, as discussed with reference to FIG. 10, is also possible.

Figure 13:
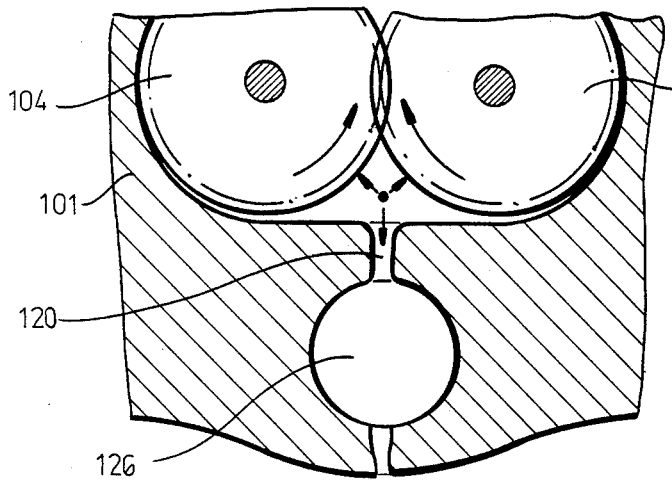
FIG. 13 is a view similar to part of FIG. 12, illustrating a modification.
Figure 14:
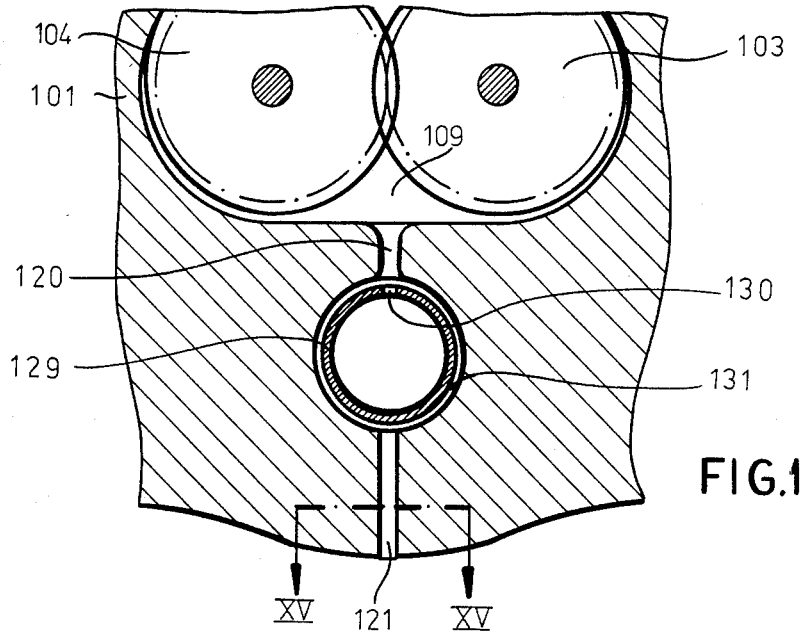
FIG. 14 shows the structure of FIG. 13 with the addition of a flow-blocking member.

In FIG. 13 we have shown the applicator body 101 provided with a cylindrical enlargement forming a horizontal lodgment 126 in its flow path, specifically in the discharge slot 120 downstream of gear pump 103, 104. This lodgment accommodates a blocking element 129 (FIG. 14) illustrated as a tube which is open at one end and is provided with one or more upstream apertures 130 facing the pressure space 109. Tube 129 is shown at 131 to be peripherally grooved so that its insertion into the lodgment 126 does not completely block the flow to outlet 121 but only throttles it; the excess fluid delivered by gear pump 103, 104 enters the tube through apertures 130 to be carried off through the open end of that tube for return to the reservoir. It will be apparent that peripheral grooves 131 could be omitted so that tube 129, with its leading end closed, can be inserted into the lodgment 126 to a selected extent for cutting off part of the outflow as described above with reference to the shutter 67 of FIG. 16. Such a tube could also be fully inserted to stop the discharge until the entire flow path through the applicator has been filled with working fluid, this being particularly important when that flow path includes a branched channel system as described with reference to FIGS. 1–6.

In FIG. 15 we have indicated details of nozzle structure 119 whose outlet 121 is occupied by an insert in the form of a foil 128 with ribs 127 subdividing the slot into a multiplicity of closely spaced discharge apertures. The ribs 127 could also be fixedly formed on, say, the left-hand boundary of slot 121.

It will be evident that the nozzle structures described with reference to FIGS. 8–10 are also suitable for the applicator of FIGS. 11–14. Furthermore, this latter applicator can likewise be oriented in various ways to discharge the working fluid laterally or from below onto a substrate surface, as discussed with reference to FIGS. 1 and 3 and as shown in the copending application Ser. No. 480,113.

We claim:

1. An applicator for uniformly distributing a flowable material over a surface of a relatively moving substrate, comprising a body provided with a channel system having a branched structure extending from an entrance port to a multiplicity of exit ports disposed in a row transverse to the direction of relative motion, the branches of said channel system becoming progressively more numerous and correspondingly narrower from said entrance port to said exit ports, said channel system forming a multiplicity of tiers paralleling said row and communicating with one another through connecting passages, the number of said branches increasing from one tier to the next, said body comprising a housing and a stack of slabs tightly lodged in said housing perpendicular to the direction of relative motion, said slabs having longitudinally extending cavities in the shape of upwardly open recesses with bottoms having restricted bores, said cavities forming respective tiers of said channel system.

2. An applicator as defined in claim 1 wherein said body is provided with shutter means externally controlled for selectively obstructing part of the branches of at least one of said tiers.

3. An applicator as defined in claim 1 wherein said body is provided in the vicinity of said outlet with a ferromagnetic armature coacting with a magnet below said substrate.

4. An applicator as defined in claim 1 wherein said exit ports open onto a discharge slot.

5. An applicator as defined in claim 4, further comprising an elastic tongue partly received in said slot and partly projecting therefrom for engagement with the relatively moving substrate surface.

6. An applicator as defined in claim 4 wherein said discharge slot is provided with an enlarged section forming a lodgment for an externally controlled shutter.

7. In an applicator for the uniform distribution of a flowable material over a surface of a relatively moving substrate, including an inlet for the flowable material, an elongate outlet transverse to the direction of relative motion and a channel system forming a flow path from said inlet to said outlet inside said body, the combination therewith of propulsion means in an intermediate space forming part of said flow path, said body being provided with two part-cylindrical cutouts flanking said flow path and having axes parallel to said slot, said propulsion means comprising two rollers with intermeshing peripheral teeth floatingly received with a slight peripheral clearance in said cutouts.

8. The combination defined in claim 7 wherein said propulsion means includes drive means for counterrotating said rollers in directions entraining the flowable material between the roller peripheries and the walls of said cutouts.

9. The combination defined in claim 7 wherein said flow path includes an enlarged lodgment separated from said intermediate space, further comprising an externally controlled flow-blocking member movable parallel to said axes in said lodgment.

10. The combination defined in claim 9 wherein said flow-blocking member is an open-ended tube with an aperture facing in the upstream direction of said flow path for carrying off excess flowable material.

11. The combination defined in claim 10 wherein said tube has peripheral grooves enabling a throtted flow past a part of said lodgment obstructed thereby.

12. The combination defined in claim 7 wherein said outlet is a slot containing a ribbed insert forming a multiplicity of narrow passages therethrough.

* * * * *